US007959454B2

(12) United States Patent
Ramasubramanian et al.

(10) Patent No.: US 7,959,454 B2
(45) Date of Patent: Jun. 14, 2011

(54) WET MATE CONNECTOR

(75) Inventors: Srikanth Ramasubramanian, Ormond Beach, FL (US); Roy Jazowski, Ormond Beach, FL (US); Gregory Sivik, Ormond Beach, FL (US)

(73) Assignee: Teledyne ODI, Inc., Daytona Beach, FL (US)

( * ) Notice: Subject to any disclaimer, the term of this patent is extended or adjusted under 35 U.S.C. 154(b) by 0 days.

(21) Appl. No.: 12/839,077

(22) Filed: Jul. 19, 2010

(65) Prior Publication Data

US 2011/0021049 A1 Jan. 27, 2011

Related U.S. Application Data

(60) Provisional application No. 61/228,058, filed on Jul. 23, 2009.

(51) Int. Cl.
*H01R 4/60* (2006.01)

(52) U.S. Cl. ..... 439/201

(58) Field of Classification Search ..... 439/201, 439/271, 138, 190, 191, 204, 206, 278, 279, 439/936

See application file for complete search history.

(56) References Cited

U.S. PATENT DOCUMENTS

| | | | |
|---|---|---|---|
| 2,700,140 | A | 1/1955 | Phillips |
| 2,740,098 | A | 3/1956 | Phillips |
| 2,758,291 | A | 8/1956 | Richards |
| 3,092,431 | A | 6/1963 | Bilbrey |
| 3,158,420 | A | 11/1964 | Olson et al. |
| 3,243,756 | A | 3/1966 | Ruete et al. |
| 3,307,137 | A | 2/1967 | Tordoff et al. |
| 3,376,541 | A | 4/1968 | Link |
| 3,471,669 | A | 10/1969 | Curtis |
| 3,513,425 | A | 5/1970 | Arndt |
| 3,522,576 | A | 8/1970 | Cairns |
| 3,559,141 | A | 1/1971 | Hardy |
| 3,587,035 | A | 6/1971 | Kotski et al. |
| 3,643,208 | A | 2/1972 | Massa, Jr. |
| 3,656,084 | A | 4/1972 | Malia |
| 3,670,287 | A | 6/1972 | Keto |

(Continued)

FOREIGN PATENT DOCUMENTS

GB 1537061 5/1976

(Continued)

OTHER PUBLICATIONS

U.S. Appl. No. 12/849,649 filed Aug. 3, 2010, inventor Jazowski.

(Continued)

*Primary Examiner* — T C Patel
*Assistant Examiner* — Phuongchi T Nguyen
(74) *Attorney, Agent, or Firm* — Procopio, Cory, Hargreaves & Savitch LLP

(57) ABSTRACT

A submersible connector has releasably mateable plug and receptacle units. The plug unit has at least one electrical pin while the receptacle unit has at least one electrical socket module which receives a forward portion of the electrical pin when the units are mated. The pin is surrounded by semi-conductive seals and a conductive housing, while the socket module has a semi-conductive outer layer, and front seals of semi-conductive material on the pin and socket modules are in sealing engagement in the mated condition, isolating the pins from sea water exposure and forming a ground plane continuation at least from receptacle to plug in the mated condition and providing shielding from phase to phase interaction in a multiple pin and socket connector.

56 Claims, 10 Drawing Sheets

U.S. PATENT DOCUMENTS

| | | | | |
|---|---|---|---|---|
| 3,678,432 | A | 7/1972 | Boliver | |
| 3,750,088 | A | 7/1973 | Berian | |
| 3,772,636 | A | 11/1973 | Webb | |
| 3,793,608 | A | 2/1974 | Ring et al. | |
| 3,816,641 | A | 6/1974 | Iversen | |
| 3,818,407 | A | 6/1974 | Edgerton | |
| 3,898,731 | A | 8/1975 | Ring et al. | |
| 3,952,218 | A | 4/1976 | Deters | |
| 3,982,812 | A | 9/1976 | Boliver | |
| 3,992,567 | A | 11/1976 | Malia | |
| 3,994,552 | A | 11/1976 | Selvin | |
| 4,006,288 | A | 2/1977 | Stevens | |
| 4,032,205 | A | 6/1977 | Taj | |
| 4,099,021 | A | 7/1978 | Venezia | |
| 4,142,770 | A | 3/1979 | Butler, Jr. et al. | |
| 4,174,145 | A | 11/1979 | Oeschger et al. | |
| 4,266,844 | A | 5/1981 | Chelminski | |
| 4,334,729 | A | 6/1982 | Allen et al. | |
| 4,373,767 | A | 2/1983 | Cairns | |
| 4,383,131 | A | 5/1983 | Clabburn | |
| 4,431,861 | A | 2/1984 | Clabburn et al. | |
| 4,521,642 | A | 6/1985 | Vives | |
| 4,606,603 | A | 8/1986 | Cairns | |
| 4,728,296 | A | 3/1988 | Stamm | |
| 4,753,604 | A | 6/1988 | Wheeler | |
| 4,790,768 | A | 12/1988 | Domingues | |
| 4,797,117 | A | 1/1989 | Ayers | |
| 4,854,886 | A | 8/1989 | Neuroth | |
| 4,874,324 | A | 10/1989 | Andersen et al. | |
| 4,909,751 | A | 3/1990 | Marolda, Jr. | |
| 4,948,377 | A | 8/1990 | Cairns | |
| 5,015,016 | A | 5/1991 | Smith, III | |
| 5,051,103 | A | 9/1991 | Neuroth | |
| 5,070,597 | A | 12/1991 | Holt et al. | |
| 5,166,477 | A | 11/1992 | Perin, Jr. et al. | |
| 5,174,765 | A | 12/1992 | Williams et al. | |
| 5,193,614 | A | 3/1993 | Cox | |
| 5,203,805 | A * | 4/1993 | Cairns | 439/199 |
| 5,361,834 | A | 11/1994 | Cox | |
| 5,645,442 | A * | 7/1997 | Cairns | 439/201 |
| 5,670,747 | A | 9/1997 | Lawer et al. | |
| 5,700,161 | A | 12/1997 | Plummer et al. | |
| 5,808,258 | A | 9/1998 | Luzzi | |
| 5,833,490 | A | 11/1998 | Bouldin | |
| 5,899,765 | A | 5/1999 | Niekrasz | |
| 5,942,333 | A | 8/1999 | Arnett et al. | |
| 6,139,354 | A | 10/2000 | Broussard | |
| 6,332,787 | B1 * | 12/2001 | Barlow et al. | 439/138 |
| 6,397,945 | B1 | 6/2002 | Manke et al. | |
| 6,443,780 | B2 | 9/2002 | Wilgourn et al. | |
| 6,464,523 | B1 | 10/2002 | Levine | |
| 6,475,008 | B1 | 11/2002 | Marolda et al. | |
| 6,659,780 | B2 | 12/2003 | Parkinson | |
| 6,677,528 | B2 | 1/2004 | Amerpohl et al. | |
| 6,910,910 | B2 * | 6/2005 | Cairns | 439/352 |
| 6,943,298 | B2 | 9/2005 | Nicholson | |
| 7,481,584 | B2 * | 1/2009 | Cairns | 385/60 |
| 7,534,147 | B2 | 5/2009 | Marklove et al. | |
| 7,658,629 | B2 * | 2/2010 | Stagi et al. | 439/204 |
| 7,695,301 | B2 * | 4/2010 | Mudge et al. | 439/271 |
| 7,699,533 | B2 * | 4/2010 | Milette | 385/75 |
| 7,794,254 | B2 | 9/2010 | Marklove et al. | |
| 2002/0064986 | A1 | 5/2002 | Hirai et al. | |
| 2004/0029443 | A1 | 2/2004 | Quadir et al. | |
| 2004/0248466 | A1 | 12/2004 | McCarthy | |
| 2006/0009073 | A1 | 1/2006 | Holliday | |
| 2007/0298654 | A1 | 12/2007 | Holliday | |
| 2008/0314616 | A1 | 12/2008 | Benestad et al. | |
| 2009/0047815 | A1 | 2/2009 | Nicholson | |

FOREIGN PATENT DOCUMENTS

| | | |
|---|---|---|
| GB | 2222032 | 2/1990 |
| GB | 2448985 | 11/2008 |
| JP | 1206813 | 8/1989 |
| JP | 2003-243101 | 8/2003 |
| KR | 20040027024 | 1/2004 |
| WO | WO8400078 | 1/1984 |
| WO | WO 9713890 | 4/1997 |
| WO | WO 2007016072 | 2/2007 |

OTHER PUBLICATIONS

U.S. Appl. No. 12/841,029 filed Jul. 21, 2010, inventor Sivik et al.
International Search Report and Written Opinion for PCT/US2010/042522, issued Jan. 27, 2011, 9 pages.
International Search Report and Written Opinion for PCT/US2010/044348 dated Feb. 21, 2011.
International Search Report and Written Opinion for PCT/US2010/042757 dated Feb. 25, 2011.

* cited by examiner

WET MATE CONNECTOR

RELATED APPLICATION

The present application claims the benefit of co-pending U.S. provisional patent application Ser. No. 61/228,058, filed Jul. 23, 2009, the contents of which are incorporated herein by reference in their entirety.

BACKGROUND

1. Field of the Invention

The present invention relates generally to connectors which can be mated and unmated in a harsh environment, such as underwater, and is particularly concerned with a wet mate or harsh environment electrical or hybrid connector suitable for medium and high voltage applications.

2. Related Art

There are many types of connectors for making electrical and fiber-optic cable connections in hostile or harsh environments, such as undersea connectors which can be repeatedly mated and demated underwater at great ocean depths. These connectors typically consist of plug and receptacle units or connector parts, each attached to cables or other devices intended to be joined by the connectors to form completed circuits. To completely isolate the contacts to be joined from the ambient environment, one or both halves of these connectors house the contacts in oil-filled, pressure-balanced chambers.

Current underwater connectors typically comprise releasably mateable plug and receptacle units, each containing one or more electrical or optical contacts or junctions for engagement with the junctions in the other unit when the two units are mated together. The contacts on one side are in the form of pins or probes, while the contacts or junctions on the other side are in the form of sockets for receiving the probes. Typically, the socket contacts are contained in a sealed chamber containing a dielectric fluid or other mobile substance, and the probes enter the chamber via one or more sealed openings. One major problem in designing such units is the provision of seals which will adequately exclude seawater and/or contaminants from the contact chamber after repeated mating and demating.

In some known underwater electrical connectors, the receptacle unit has a stopper which is positioned in sealing engagement with an annular end seal when the units are not mated. The chamber sealed by the stopper and end seal contains a circuit contact and dielectric mobile substance. The receptacle unit may have one such contact chamber or plural contact chambers each sealed by respective stoppers in the end seal, depending on the number of connections to be made. As the plug probe enters the chamber, it pushes the stopper back, enters the inner chamber, and makes electrical contact with the circuit connection. At the same time, the end seal will seal against the plug probe to ensure that water cannot enter the chamber. This provides a robust and reliable electrical connector for use in deep sea or other harsh environments. Such connectors are generally known as pin-and-socket type connectors and one such connector is described in U.S. Pat. No. 5,645,442 of Cairns. This connector is manufactured and sold by Ocean Design, Inc. under the name Nautilus®. U.S. Pat. No. 6,332,787 of Barlow et al. describes a similar electrical connector arrangement in an electro-optical connector for connecting both electrical and optical circuits.

In a pin-and-socket connector, each plug pin or probe has an elongated shaft enclosed in a dielectric sheath along most of its length, with an exposed conductive tip which contacts the corresponding electrical socket contact in the mated condition. The probe or pin projects forwardly from a dielectric base member in the plug unit so that at least part of the body of the probe is exposed to the surrounding environment when the connector units are unmated. When the pin engages in the contact chamber of the mating receptacle unit, the contact chamber is sealed by the sealing engagement of the end seal with the dielectric sheath of the plug pin or probe.

One problem with such connectors is that the front portion of any electrical pin is partially exposed to seawater in the fully mated condition, potentially increasing electrical stress, and also resulting in degradation of exposed parts of the pin due to extended exposure to seawater.

SUMMARY

Embodiments described herein provide a new wet mate or harsh environment connector suitable for electrical applications.

In one embodiment, a submersible or harsh environment connector is provided which comprises first and second connector units which are releasably mateable together. In one embodiment, the first connector unit is a plug unit which contains one or a plurality of electrical circuits which terminate in contacts carried on the ends of pins or probes. The second connector unit is a receptacle unit which contains a corresponding number of electrical circuits which terminate in contact sockets which connect with the pin or probe contacts which enter the receptacle unit when the two units are fully mated. The connector may be electrical only, or may be a hybrid electrical and optical connector. In one embodiment, the plug unit has at least one electrical contact pin which projects from a forward end face of the connector unit, with an exposed contact at the tip of the pin. A slidably mounted stopper in the receptacle unit is biased into an extended position in an unmated condition of the units to seal a forward end opening of a contact chamber containing the contact socket, and is engaged and pushed back by the opposing pin as the plug and receptacle units move into mating engagement. At least one end seal engages over at least part of the forward end portion of the stopper in the unmated condition, and engages a front seal on the pin as the units are mated.

In one embodiment, the contact chamber in the receptacle is surrounded by a dual bladder assembly comprising an inner bladder and an outer bladder, and forward end portions of the outer and inner bladder engage the stopper to form a dual end seal in the unmated condition, with the forward end portion of the outer bladder comprising the primary end seal and the forward end portion of the inner bladder comprising a secondary end seal. The forward end portions of the inner and outer bladder seal against the outer surface of the plug pin as it extends into the contact chamber and into contact with the contact socket. If the plug and receptacle units form a multiple circuit connector, a plurality of contact sockets in the receptacle unit each have their own individual contact chamber with separate dual bladder assemblies surrounding each contact chamber and terminating in forward end seal portions which seal against the respective stoppers when the unit is unmated and seal against aligned pins in the plug unit as the units are mated.

In one embodiment, the outer bladder has an outer layer of semi-conductive material which forms at least part of the primary end seal of each socket module, and the front seal of each pin in the plug unit is also of semi-conductive material to form a ground plane continuation along the length of the receptacle unit and from the receptacle unit to the plug unit when the units are mated. The pin or pins on the plug unit are each surrounded by semi-conductive seals and a conductive housing to provide a ground plane or shield. This arrangement shields the circuits from one another in a multi-phase system, and also seals the plug pin from the surrounding environment such as sea water when the plug and receptacle units are mated. The ground plane continuation from end to end helps to prevent phase to phase interaction in a multi-phase system, which can occur in multiple circuit connectors which are unshielded.

The dual bladder assembly forms an inner chamber inside the inner bladder in which the contact socket is located, and an outer chamber between the inner and outer bladders. Each chamber may be filled with a dielectric oil or mobile substance. In one embodiment, the end seal of the inner bladder is axially spaced from the end seal of the outer bladder to leave a gap where the outer surface of the stopper is exposed, and one or more channels are provided between front end portions of the inner and outer bladders to connect the outer dielectric chamber to the gap. The channel serves as a passageway into the outer dielectric chamber for foreign particles such as sand, silt or water on the outside of the pin that may enter and accumulate after repeated mating and unmating of the units.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a wet mate (submersible or harsh environment) connector for simultaneously joining one or more electrical circuits. In one embodiment, a three phase connector is provided which simultaneously joins three circuit conductors. The connector has mateable plug and receptacle units with at least one pin on the plug entering a contact chamber in the receptacle on mating, and a sealing arrangement which provides a ground plane continuation from the receptacle to the plug during mating and in the mated condition of the units.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention.

Figure 1:
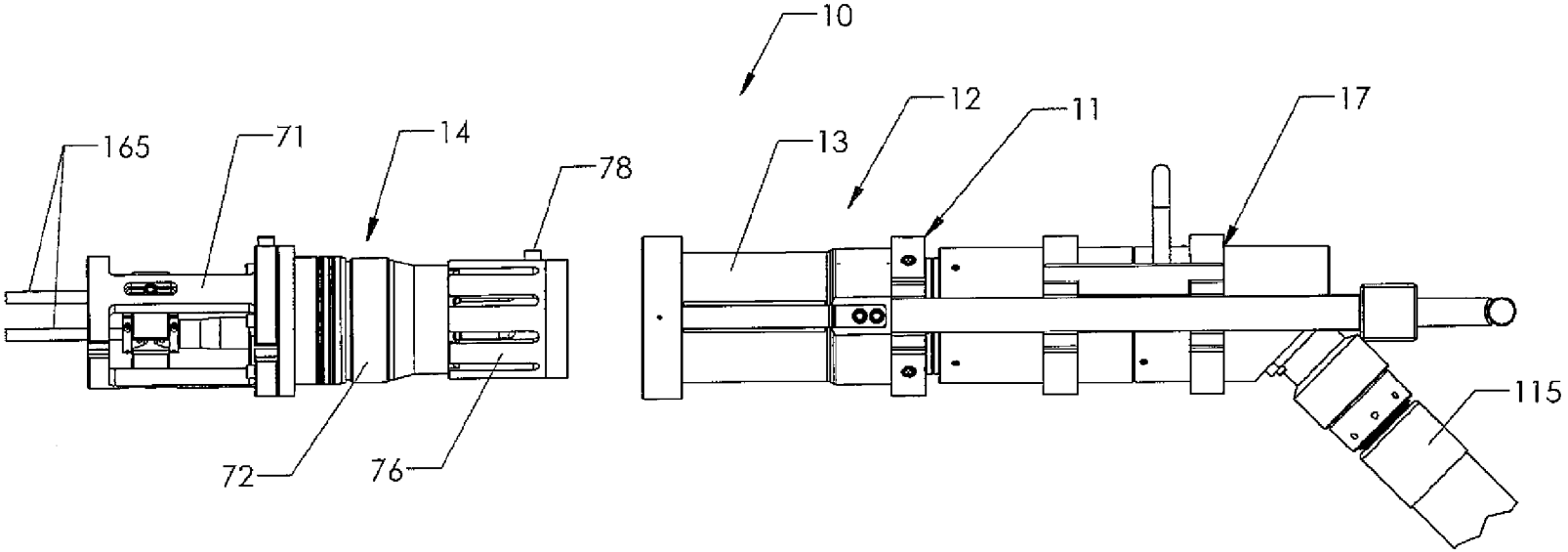
FIG. 1 is a perspective view of the unmated components of one embodiment of a harsh environment or wet mate connector.

FIGS. 1 to 13 illustrate a harsh environment or wet mate pin and socket electrical connector 10. Although the connector is electrical only in the illustrated embodiment, it may also be a hybrid electro-optical connector including optical circuits. The connector comprises a first connector unit or plug unit 14 as illustrated in FIGS. 10 and 11 and a second connector unit or receptacle unit 12 as illustrated in FIGS. 2 to 9. FIG. 1 illustrates the connector in an unmated condition with the receptacle side 11 including a standard connector slide shell 13 extending over the forward end of the receptacle unit and a standard, two part termination shell assembly 17 extending over the rear end of the receptacle unit and a cable splice to hose 115 which houses the cables in dielectric media.

Figure 12:
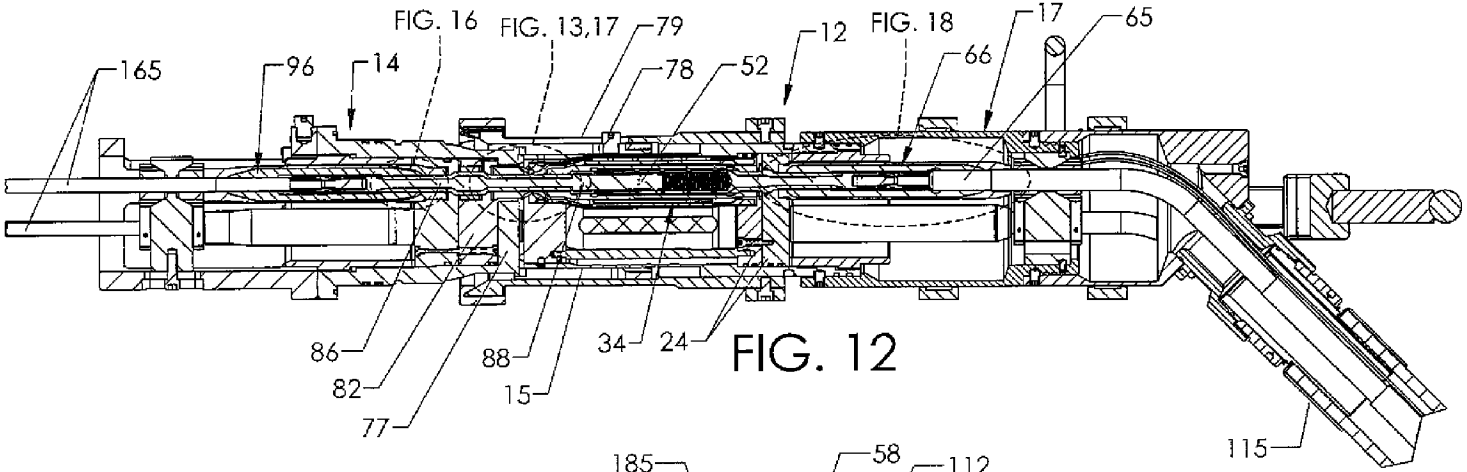
FIG. 12 is a longitudinal cross-sectional view illustrating the plug and receptacle of FIGS. 2 and 10 in the fully mated condition.
Figure 13:
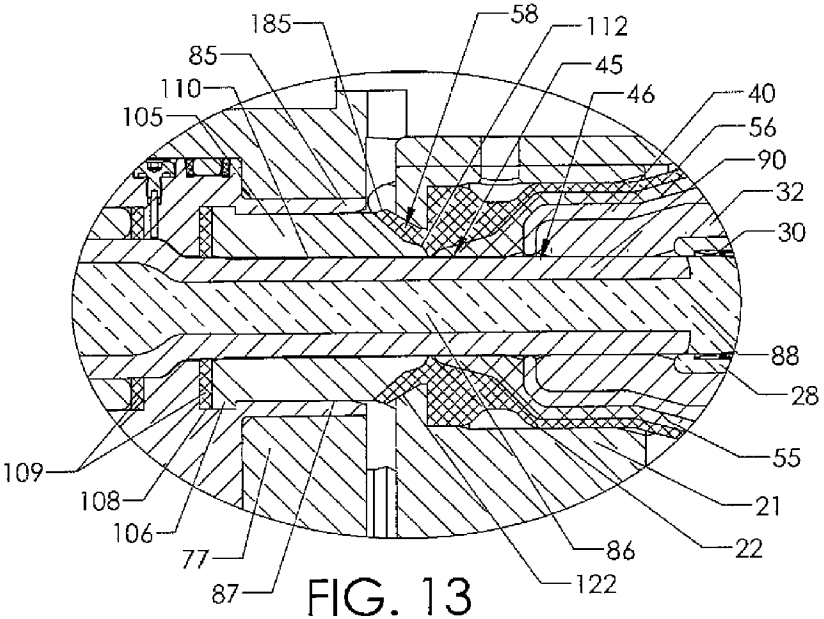
FIG. 13 is an enlarged view of the circled area labeled FIG. 13 in FIG. 12 illustrating the plug and receptacle seal arrangement in the mated condition of the units.

The plug and receptacle units are illustrated in a fully mated condition in FIGS. 12 and 13, with FIG. 13 illustrating the mating ends of the units, so as to better illustrate the operation of the receptacle and plug seal assemblies. The connector 10 is similar in some respects to the harsh environment or underwater connector described in U.S. Pat. No. 5,645,442 of Cairns, the contents of which are incorporated herein by reference. In the illustrated embodiment, connector 10 is a three phase connector, but alternative embodiments may be single phase or other multiple phase connectors.

The receptacle unit 12 is illustrated in more detail in FIGS. 2 to 8, and has an outer shell 19 with a smaller diameter forward end portion 15 for sliding engagement in an open forward end portion of the plug unit 14, as described in more detail below. The shell has a through bore 16 in which one or more receptacle modules 18 are mounted. In this embodiment, three electrical socket or receptacle modules 18 are provided and positioned in alignment with corresponding electrical pins or probes 20 of the plug unit 14 when the units are in mating engagement. A greater or lesser number of electrical socket modules may be provided in the shell in alternative embodiments, depending on the number of circuits to be joined. The shell 19 has a forward end wall or plate 21 with openings 22 into which forward ends of the respective receptacle modules extend. The rear ends of the receptacle modules are retained in rear end plates or web plates 24 secured in place by web retaining nut 25, and the front end and rear end plates are separated by stand-off rods 23. Plates 24 are of metal such as stainless steel.

Figure 2:
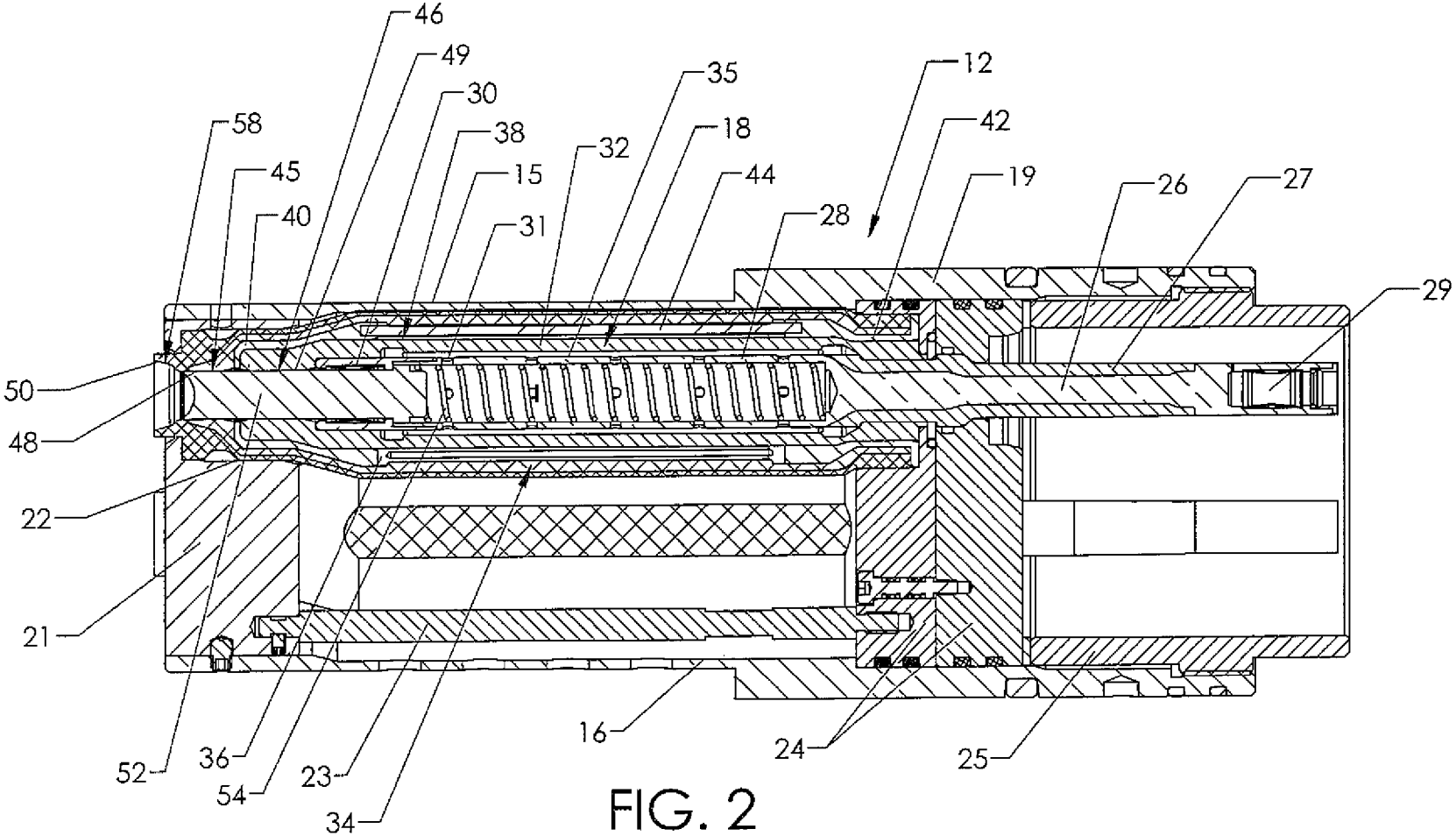
FIG. 2 is a longitudinal cross-sectional view of the unmated receptacle unit of FIG. 1 without the outer connecting slide shell, termination shell, handle and hose exit of FIG. 1.
Figure 3:
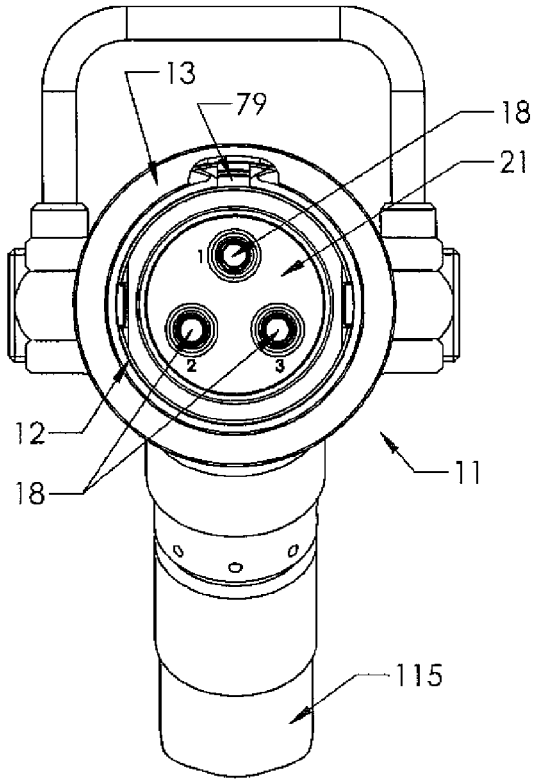
FIG. 3 is a front end elevation view of the unmated receptacle in FIG. 1.
Figure 5:
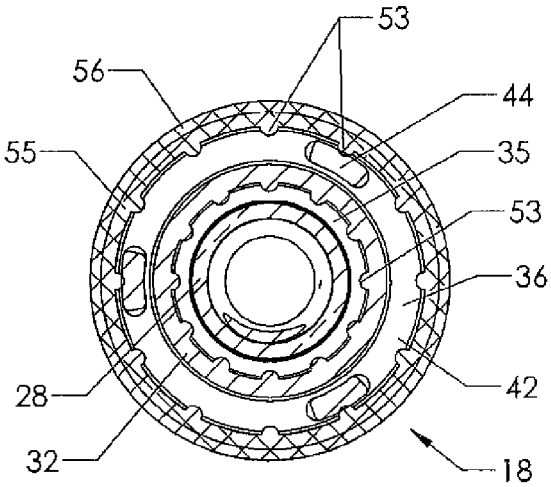
FIG. 5 is a transverse cross-sectional view of the receptacle module on the lines 5-5 of FIG. 4.
Figure 4:
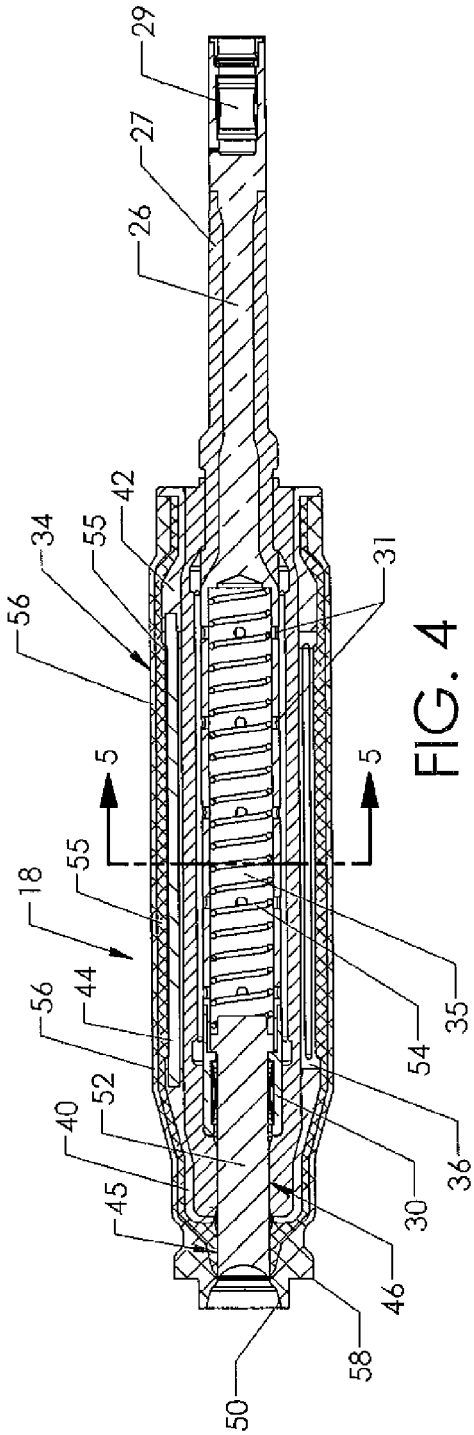
FIG. 4 is a longitudinal cross-sectional view of one receptacle module of the receptacle of FIG. 2.

As illustrated in FIGS. 2 and 4, each receptacle module 18 includes a conductive member 26 which extends through the rear web plates 24 and has a tubular portion 28 projecting forward from the web plates. The portion of member 26 extending through plates 24 is surrounded by an insulating layer 27, which terminates short of the rear end of the conductive member 26. Member 26 has a rear end socket 29 with a contact band to receive the end of a wire or conductor 65 extending from hose 115 in a conventional manner (see FIG. 9). Electrical socket or contact band 30 is located in the forward end of tubular portion 28. Inner and outer bladders 32, 34 of flexible elastomeric material surround the conductive member and define a first dielectric chamber 35 within bladder 32 in which the electrical contact band 30 and tube or sleeve 28 are located, and a second dielectric chamber 36 between the inner and outer bladders. Ports 31 in tube or sleeve 28 provide communication between portions of chamber 35 inside and outside tube 28. A bladder support 38 of rigid, insulating or dielectric material such as Ultem® 2300 is located between the inner and outer bladders. Bladder support 38 has a front tubular end portion 40, a rear tubular end portion 42, and a plurality of bladder support plates or stand-offs 44 extend between the front and rear end portions. In the illustrated embodiment, three bladder support or stand-off plates or rods are provided, but a greater or lesser number may be included in alternative embodiments. The bladder support 38 has inner and outer support portions at its front and rear ends that provide support or mounting surfaces for the inner and outer bladder.

Figure 6A:
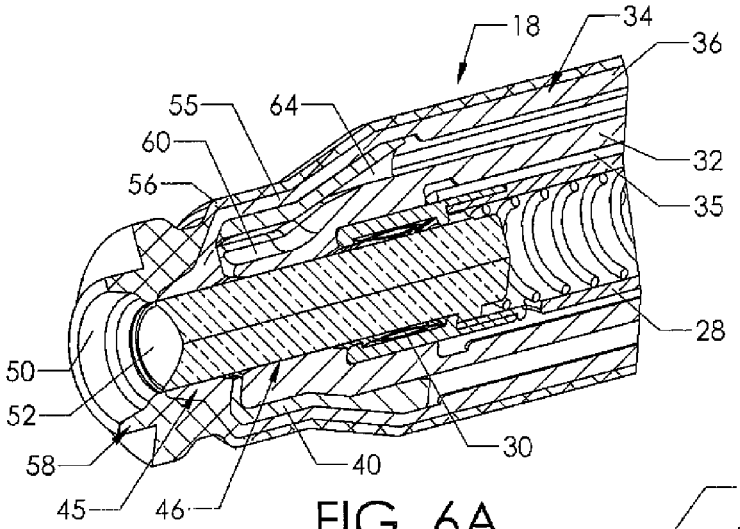
FIG. 6A is an enlarged, broken away perspective view of a front end portion of the receptacle module, revealing the front seal arrangement of one embodiment.
Figure 6B:
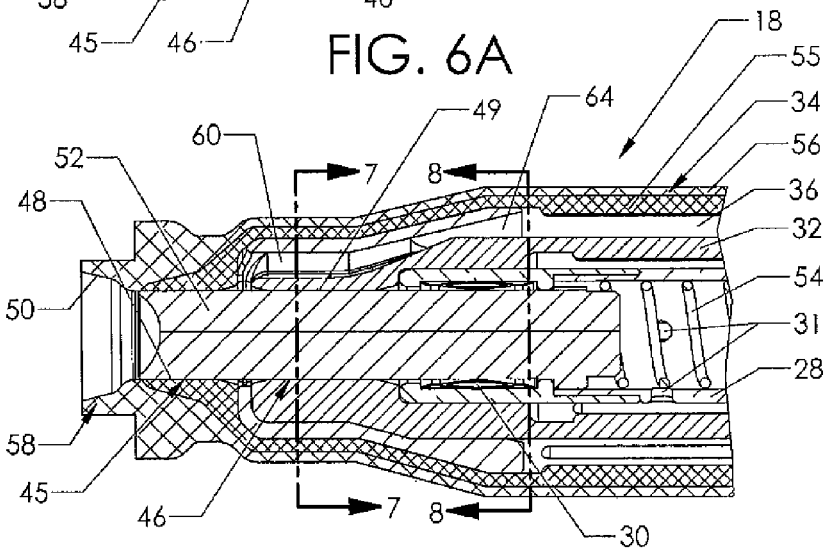
FIG. 6B is an enlarged longitudinal cross-sectional view of the same front end portion of the receptacle module which is shown in FIG. 6A.

As best illustrated in FIGS. 6A and 6B, outer bladder 34 has a forward end portion secured to the outside of the front tubular end portion 40 of the bladder support 38, and extending forwards from the bladder support to form a primary or forward end seal 45 which extends through the opening 22 in end plate 21. Inner bladder 32 has a forward end portion secured to the inside of the front end portion of bladder support 38 and extends forward from the contact band 30 to form a secondary or additional end seal 46 between the primary end seal 45 and contact band 30. The end seals 45 and 46 have aligned through bores 48, 49 forming a passageway into the contact chamber 35, and the outer end of through bore 48 has a tapered inlet aperture 50 which is of generally frusto-conical shape. A movable dielectric stopper 52 extends through the end seals in the unmated condition, and is biased into the extended position of FIG. 4 by a compression spring 54 located in tubular portion 28 of the conductive member and acting against the inner end of stopper 52. In the extended position, the stopper is in sealing engagement with the passageways 48, 49 in bladder end seals 45 and 46 respectively, so as to seal the outer chamber 36 and the contact chamber 35 inside tubular portion 28. The two end seals form independent gland seals. The end seals exert a radially constrictive sealing force on the stopper, forming a mobile substance and pressure resistant barrier. The rear ends of the inner and outer bladders are secured to the rear end portion of bladder support 38 and retained in one of the rear plates 24, as illustrated in FIG. 2.

In this embodiment, each individual contact pin in the receptacle has its own, independent set of inner and outer bladders which form gland seals on the stopper at the forward end of the contact chamber in the unmated condition of the receptacle unit. Chambers 35, 36 contain a dielectric fluid such as dielectric oil or other mobile dielectric substance, forming two independent dielectric fluid chambers around the respective contact pins. The inner and outer bladders each have a series of longitudinally extending ribs 53 on their inner surfaces (see FIGS. 5 and 6B) for added strength. The inner bladder is of a suitable insulation material such as silicone. The outer bladder 34 is a two material, two layer bladder. The two layers 55, 56 may be bonded together, for example by vacuum gluing, or may be formed integrally, for example by molding, with no voids or substantially no voids between the layers. In one embodiment, the inner layer 55 is an insulative material such as silicone, and the outer layer 56 is of a semi-conductive material such as silicone or fluorosilicone. The dielectric fluid inside each bladder is a suitable fluid compatible with the silicone bladder material which does not cause the silicone bladder material to swell, as known in the art. Outer layer 56 is of nominal thickness along most of the length of the bladder, and has an enlarged forward end portion 58 between the forward end of inner layer 55 and portions of front end wall 21 surrounding opening 22. Part of the forward end portion 58 extends forward through front end wall 21 and forms the inlet aperture or end seal portion 50 which is shaped to seal against an opposing face of an aligned plug pin front seal when the plug and receptacle are mated, as described in more detail below. The outer layer 56 may comprise a semi-conductive elastomeric material or may be a thin coating of non-elastomeric semi-conductive material painted onto the outer surface of inner layer 55. The semi-conductive outer layer of the bladder forms a ground plane which surrounds and isolates the socket module from other phases in a multiple pin/module configuration.

Figure 7:
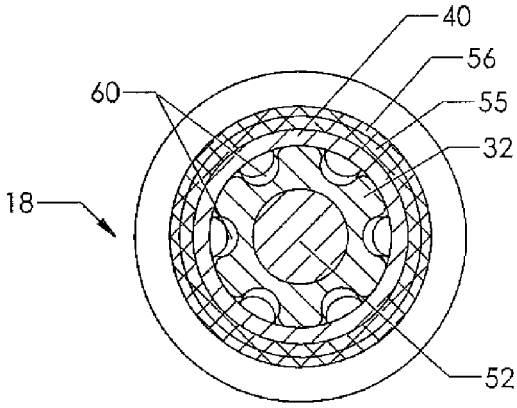
FIG. 7 is a transverse cross-sectional view of the receptacle module on the lines 7-7 of FIG. 6B.
Figure 8:
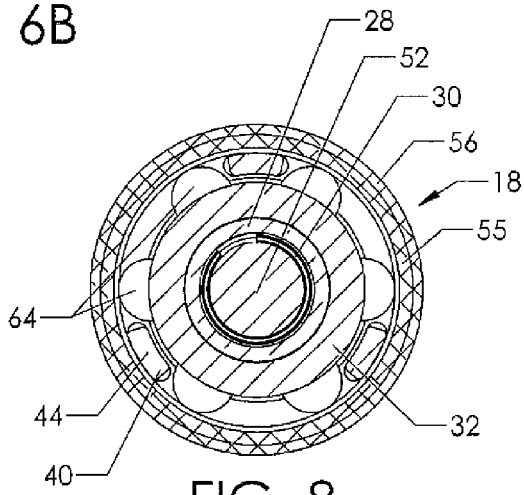
FIG. 8 is a transverse cross-sectional view of the receptacle module on the lines 8-8 of FIG. 6B.

As best illustrated in FIGS. 6A and 7, the inner bladder has a series of channels or grooves 60 which each extend across the front end face of the secondary end seal 46, and axially along the outer surface of the secondary end seal, to form passageways between the end seal 46 and the front end portion 40 of the bladder support 38. The inner surface of the front end portion 40 of the bladder support also has channels or passageways 64 extending from its inner end face (see FIGS. 6A and 8) which converge and join with the channels or grooves 60 on the outer surface of the secondary end seal 46. This forms passageways which connect the outer dielectric chamber 36 with the space between the end seals 45 and 46 of the outer and inner bladders. The channels 60, 64 also serve as passageways for foreign particles such as water, sand, silt and the like which may enter the space between the seals and accumulate after repeated mating and de-mating. The passageways help to direct such particles to flow away from the high voltage core of the receptacle or socket module 18. Any foreign particles which enter the inner chamber at certain locations tend to create electrical stress. The passageways between the end seals tend to direct any foreign particles away from the inner chamber and into the outer chamber, reducing such electrical stress. The dual barrier formed by the spaced end seals also helps to shield the inner chamber against foreign particles entering the chamber and to maintain the mated contacts within a somewhat pristine environment. The passageways are also arranged to direct any particles entering the outer chamber towards the outer periphery of the outer chamber, so that they have little or no influence on the high voltage field and create little or no electrical stress. In the illustrated embodiment, six circumferentially spaced passageways into the outer chamber are provided, but a greater or lesser number of passageways may be provided in alternative embodiments.

Figure 9:
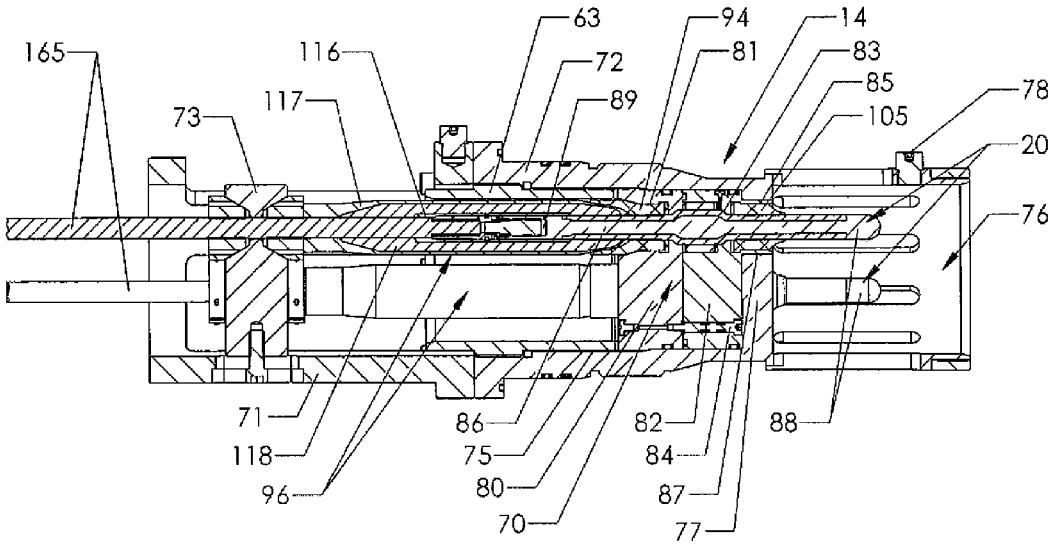
FIG. 9 is a longitudinal cross-sectional view of the unmated plug unit of FIG. 1.
Figure 10:
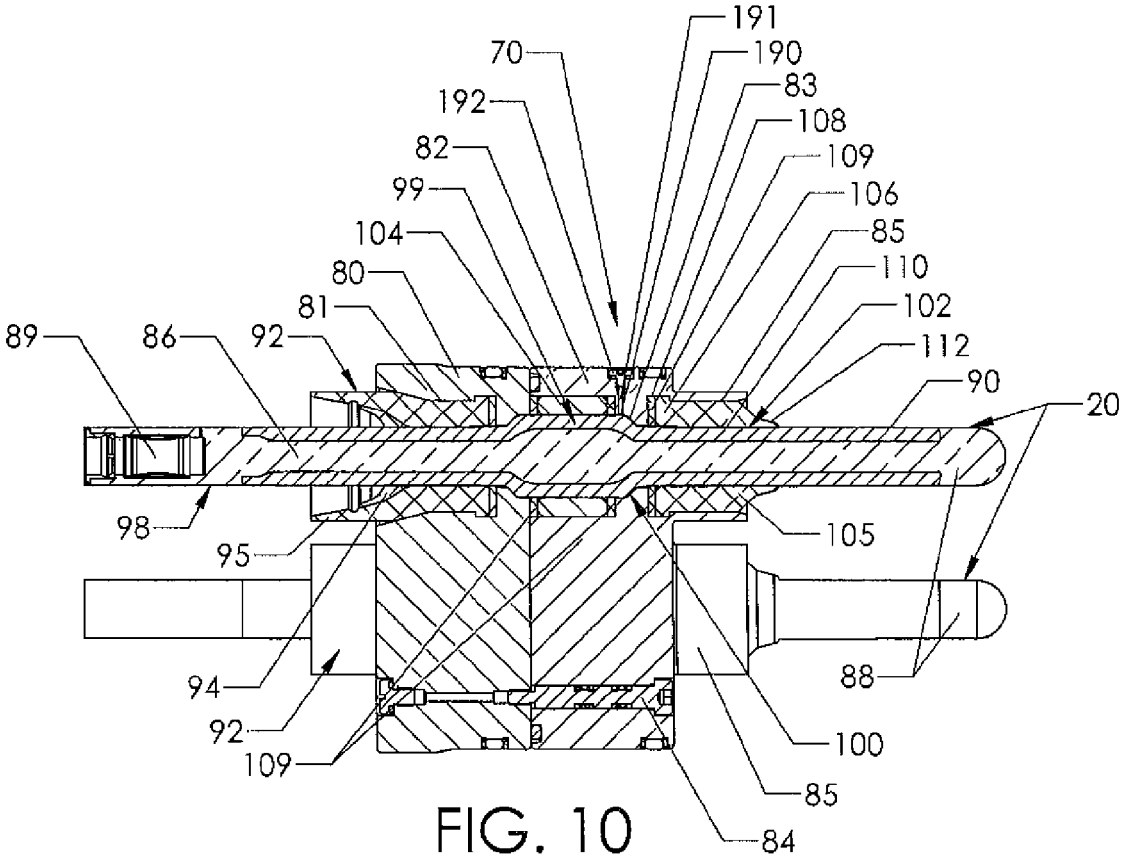
FIG. 10 is a longitudinal cross-sectional view similar to FIG. 10 but with the outer shell and cable splice components omitted to reveal details of the plug penetrator module subassembly.

Plug unit 14 is illustrated in FIGS. 9 and 10, with FIG. 10 illustrating the plug module or penetrator subassembly 70 without the outer shell. As illustrated in FIG. 9, plug unit 14 comprises an outer cylindrical shell 72 of rigid material having a bore 75, a recessed front wall 77 having openings 87 aligned with the plug probes or pins 20 which extend through the wall, and an open forward end sleeve 76. A conventional alignment key 78 projects radially outwardly from the shell 72. When the plug and receptacle units are secured together, key 78 will engage in axial alignment keyway 79 in the receptacle (see FIG. 3), as is known in the field. This provides proper alignment of the electrical pins and sockets in the plug and receptacle units as the units are mated together. FIG. 9 also illustrates a rear adapter or termination shell 71 containing cable support clamp 73 and surrounding the spliced rear ends of contact pins 20.

In this embodiment, the plug module 70 of FIG. 10 is secured in through bore 75 and has a two part base 80, 82 for guiding and retaining the electrical pins 20. The two part base comprises a plug or base plate 80 of rigid material and a retaining member or web plate 82 which is secured to the front of the base plate 80 via fastener screws 84. The plates 80 and 82 are secured between web retaining nut 63 which engages in the rear open end of bore 75 and the recessed front wall 77 of the plug shell, as illustrated in FIG. 9. Plates 80 and 82 have aligned through bores 81, 83 through which respective electrical probes or pins 20 project. The second or front plate 82 has a series of annular projections 85 on its front face which extend into the respective front wall openings 87 as illustrated in FIG. 9 and surround the respective pins 20 as they project forwardly through wall 77. The probes or pins 20 are positioned for alignment with respective receptacle modules in the receptacle 12, and in the illustrated embodiment three pins are provided, although a greater or lesser number may be provided in alternative embodiments. The plates 80 and 82 are of metal.

Figure 11A:
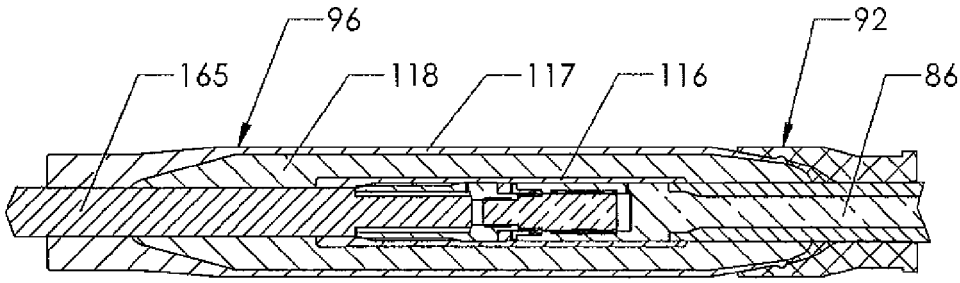
FIG. 11A is a longitudinal cross-sectional view of the rear end of one pin attached to a cable via a cable conductor splice.
Figure 11B:
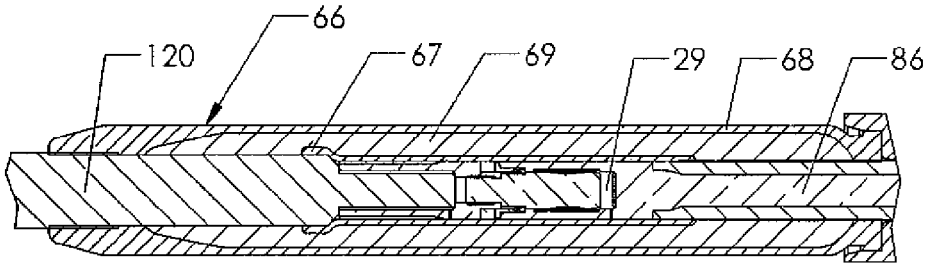
FIG. 11B is a longitudinal cross-sectional view similar to FIG. 11A but illustrating an alternative termination of the rear end of one pin attached to a cable having unshielded cable leads.

Each pin or probe 20 comprises a conductive probe shaft 86 of suitable conductive metal such as copper, which has a rear end socket 89 and extends through the aligned bores 81, 83 in plates 80, 82 and out through end wall 77, terminating in a conductive tip or contact 88. Shaft 86 has an outer protective insulation layer 90 of dielectric material which forms a primary insulator which extends along most of the length of the pin, terminating short of the conductive tip 88. As best illustrated in FIG. 11A, a two layer rear seal or stress relieving gland seal 92 surrounds the pin as it exits out of the rear end of plate 80. Rear seal 92 has a first layer 94 of silicone insulating material and a second layer 95 of fluorosilicone semi-conductive material. This provides electrical stress control in addition to being a hydrostatic seal member. The rear end of each pin is suitably connected to a respective conductor 165 at the end of an electrical cable and sealed with a three layer boot seal 96 (FIG. 9), as illustrated in more detail in FIG. 11A. Although each pin has a rear end socket for engagement with a conductor end as illustrated in FIG. 11A or 11B in the illustrated embodiment, other cable conductor connecting formations may be used in alternative embodiments, such as internal or external threads.

The pin 20 is of stepped diameter, with a reduced diameter rear end portion 98, an enlarged diameter intermediate portion 99 extending from the through bore 81 in base plate 80 into the front plate through bore 83, and a tapered step 100 leading to a reduced diameter forward end portion 102 which projects forward out of the through bore 83. The through bore in the front plate 82 is of similarly stepped diameter for close engagement with the different diameter portions of the outer insulation layer 90, as seen in FIG. 10. A bleed hole 190 normally covered by a removable cap 192 extends from through bore 83 to the outer circumferential surface of the front plate 82 adjacent step 100, as best illustrated in FIG. 10. An insulative plastic piece 191 extends from the inner end of cap 192 to fill the bleed hole. The bleed hole makes it easier to overcome any hydrolock during assembly.

A gland seal 104 is provided in the through bore 83 for sealing engagement with the pin insulation layer 90, and a front seal 105 is engaged over a forward portion of each pin with the rear end or annular rim 106 of the seal seated in a matching annular seat or indent 108 (FIG. 13) in the through bore 83. Back up rings 109 may be provided at the inner ends of front seal 105, rear seal 92 and at opposite ends of gland seal 104. Front seal 105 extends forward from seat 108 and out through the wall 77, and has a through bore 110 of suitable dimensions for sealing engagement with the opposing outer surface of the outer dielectric casing 90 of the pin in the unmated condition of FIG. 10. A tapered forward end portion 112 of front seal 105 projects forwards from wall 77 and is configured for sealing engagement in the tapered inlet 50 of the aligned end seal 45 of the receptacle when the units are fully mated, as described in more detail below. The front seal 105 is of semi-conductive material, and may be of silicone or fluorosilicone semi-conductive material or the like. Thus, each pin 20 of the plug unit is surrounded by semi-conductive seals and a metal housing, forming a continuous ground plane or shield.

In the illustrated embodiment, the front pin seal 105 is a single layer of semi-conductive material. In alternative embodiments, pin seal 105 may alternatively comprise an outer layer of elastomeric or non-elastomeric semi-conductive material and an inner layer of electrically insulating material engaging the pin. The outer layer may be a layer of semi-conductive, elastomeric material bonded or integrally formed with the inner insulating layer, or may be a thin coating of non-elastomeric semi-conductive material painted onto the inner layer. The shape of the two layer front pin seal may be similar to that of the single layer seal illustrated in FIGS. 10, 12 and 13, except that the interface between the inner and outer layers is similar to the interface between layers 94 and 95 of rear seal 92. Rather than abruptly ending at a right angle onto the insulation layer of pin 20 as is the case with the single layer front pin seal of FIG. 10, the insulating inner layer in the two layer alternative may taper down smoothly to meet the pin insulating layer at the rear end of the pin seal.

On the rear end of each module, each pin 20 is terminated to a respective cable conductor and sealed by a boot seal. FIGS. 11A and 11B illustrates two possible terminations for a pin of the plug module, and the same terminations are also used for the rear ends of conductive member 26 of the receptacle unit. The termination is different depending on whether the connection is to an unshielded electrical cable 165, as in FIG. 11A, or to a shielded cable 120, as in FIG. 11B. In the unshielded cable arrangement of FIG. 11A, the rear end 86 of the plug pin is connected to the end of the unshielded cable contact 165 and the connection is surrounded by a three layer boot seal 96 which has a protective fluorosilicone outer layer 117, a insulating middle layer 118 of silicone or the like, and a semi-conductive silicone or fluorosilicone inner layer 116. An electrical stress relieving gland seal or rear end seal 92 surrounds the inner end of seal 96 at the rear end of plate 80. This seal has a shaped or flared inner surface which acts to smooth and spread the field outwardly, as described in more detail below in connection with FIG. 16.

FIG. 11B illustrates an alternative shielded termination arrangement for the rear end of each plug pin 20 where it is connected to a cable with shielded cable leads 120. The connection is surrounded by a boot seal 66 comprising semi-conductive inner and outer layers 67 and 68 separated by an insulating middle layer 69. In one embodiment, the inner layer 67 is of semi-conductive silicone, the middle layer 69 is of insulating silicone, and the outer protective layer 68 is of semi-conductive fluorosilicone.

FIGS. 12 and 13 illustrate the plug 14 and receptacle 12 in a fully mated condition. As the two units are brought together with their front ends facing one another, the forward end portion 15 of the receptacle shell starts to enter the bore 76 at the front end of the plug shell, assuming that the key 78 is properly lined up with the keyway 79 in the receptacle shell. As the portion 15 continues to travel into the plug shell, the conductive tips 88 of pins or probes 20 will enter the tapered front openings 50 in the primary end seals 45 in the front wall of the receptacle shell and engage the forward ends of the aligned dielectric stoppers 52. Continued movement of the receptacle shell into the plug shell will cause the electrical probes to push the stoppers inwardly, compressing springs 54, until each conductive tip 88 is in electrical contact with the respective contact band or socket 30, establishing electrical connection between the plug and receptacle units. At the same time, the forward end portion 112 of each pin front seal 105 enters the respective mating tapered entrance 50 of the aligned forward end portion 48 of the receptacle end seal 45. The matching tapered faces of opening 50 and end portion 112 are in sealing engagement in the fully mated position illustrated in FIGS. 12 and 13. As illustrated in FIG. 13, the forward end 122 of the opening 22 in receptacle end wall 21 is outwardly tapered and squeezes the forward end of seal portion 58 against an opposing tapered face of plug front seal 105.

When the units are fully mated, the spaced end seals 45 and 46 at the front end of the receptacle module are in sealing engagement with the pin 20, and a ground plane continuation from the receptacle 12 to the plug 14 is formed by the semi-conductive outer layer 56 on the outer bladder of the receptacle and the semi-conductive front seal 105 on the plug. The semi-conductive layer of the primary end seal 45 of the receptacle and front seal 105 of the plug are in mated, sealing engagement in the fully mated condition, as illustrated in FIG. 13, thereby forming the ground plane continuation or connection between the plug and receptacle units and also isolating the plug pin from seawater exposure. When the units are mated, the ground plane is continuous and the connected circuits are shielded from each other in the 3 phase system.

Figure 14:
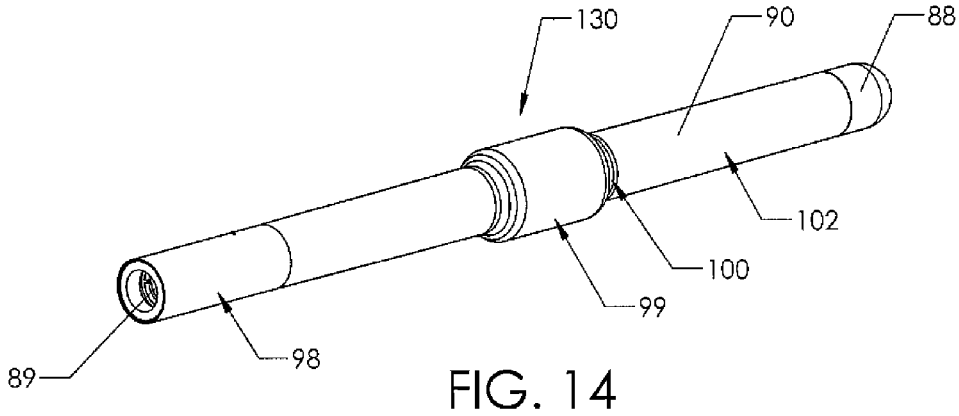
FIG. 14 is a perspective view of a modified conductor pin which may be used in place of the conductor pin in the plug unit of FIGS. 9 to 13.
Figure 15:
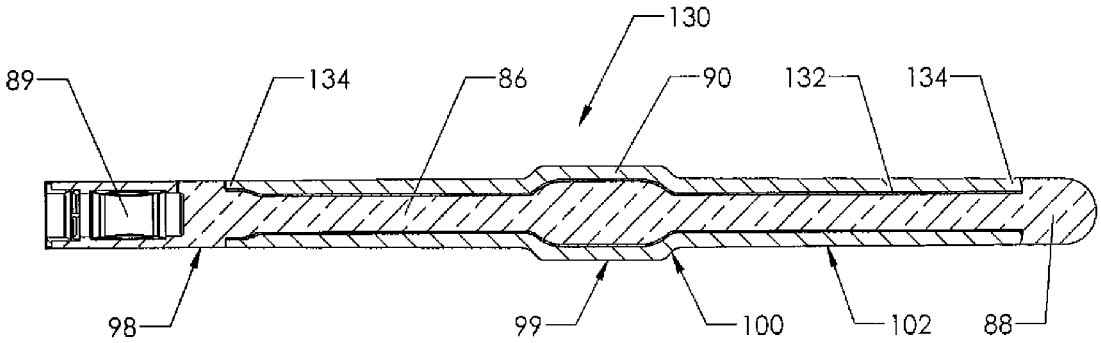
FIG. 15 is a longitudinal cross-sectional view of the conductor pin of FIG. 14.

FIGS. 14 and 15 illustrate a modified conductor pin 130 which may be used in the plug 14 in place of conductor pin or pins 20. The conductor pin 130 is similar in some respects to conductor pin 20, and like reference numbers have been used for like parts as appropriate. However, unlike pin 20, pin 130 has a layer 132 of hard or rigid semi-conductive material sandwiched between the conductive shaft 86 and insulating layer 90. The purpose of layer 132 is to provide a bonded interface at the inner surface of the insulating layer 90 which at least substantially eliminates electrical discharges as a result of voids between the conductor and insulator, which may otherwise degrade the insulation and ultimately result in component failure. Thus, layer 132 is designed to form a substantially void-free layer between the conductive shaft and the insulating layer, to at least substantially eliminate detrimental electrical stress and discharge effects of potential voids between the conductor and the insulation of the conductor when the insulation is applied directly to the conductor pin, as in the embodiment of FIGS. 10 to 13. The insulation may be of any dielectric material, including but not limited to engineering plastic and ceramic material. The semi-conductive layer 132 is a relatively thin layer of a rigid semi-conductive material such as a resin material or resin paint containing carbon particles, a silver-plated copper shielding material, a moly-manganese sintered coating, or the like. The thickness of layer 132 may be of the order of one micron.

The sandwiched semi-conductive layer material can be applied by various methods, including but not limited to painting or coating a layer of semi-conductive material over the recessed part of the conductor pin, powder coating a layer of semi-conductive material over the recessed part of the pin, applying the layer of semi-conductive material to the recessed part of the pin by a physical vapor deposition process (PVD), or applying the layer of semi-conductive polymer material by injection molding, with or without a post-molding machining operation to achieve controlled layer thickness. After the semi-conductive layer is applied by any of the foregoing methods, the insulation material layer is injection molded over the semi-conductive material. In an alternative embodiment, the insulation layer 90 for the pin may be a pre-formed annular tube with semi-conductive material applied to the inner surface of the tube by any of the foregoing techniques, e.g. painting, coating, powder coating, PVD, or the like. The conductor pin may then be inserted and bonded to the semi-conductive layer by electron beam welding or the like. In the latter case, the conductor pin is of uniform, non-stepped outer diameter and the tube is of substantially matching, uniform inner diameter.

The semi-conductive layered pin 130 of FIGS. 14 and 15 is not limited to the wet mateable connector of FIGS. 1 to 12 and may be used in the plug parts of other connectors which have plug units containing one or more conductor pins with insulating layers extending along part of their length. Alternative semi-conductive layered pins may have different end connectors depending on the cable end connector to which the pin is to be joined at the rear end of the plug unit. In the above embodiments, the pin has a connector socket 89 with a contact ring at its rear end. In alternative embodiments, the connector socket may be replaced with an externally threaded end portion for connection to a threaded socket cable connector, for example, or other types of end connectors.

Figure 17:
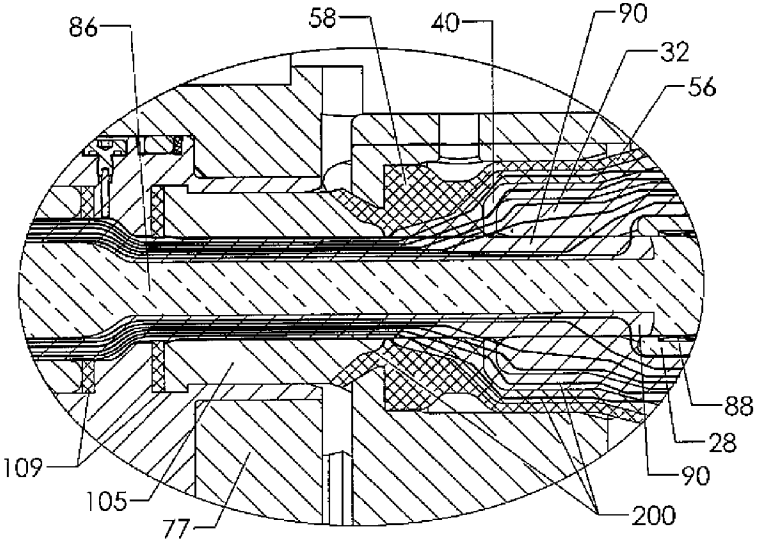
FIG. 17 is a view similar to FIG. 13 illustrating the dielectric field equipotential lines at the interface between the plug front seal and receptacle forward end seal of FIG. 13.
Figure 18:
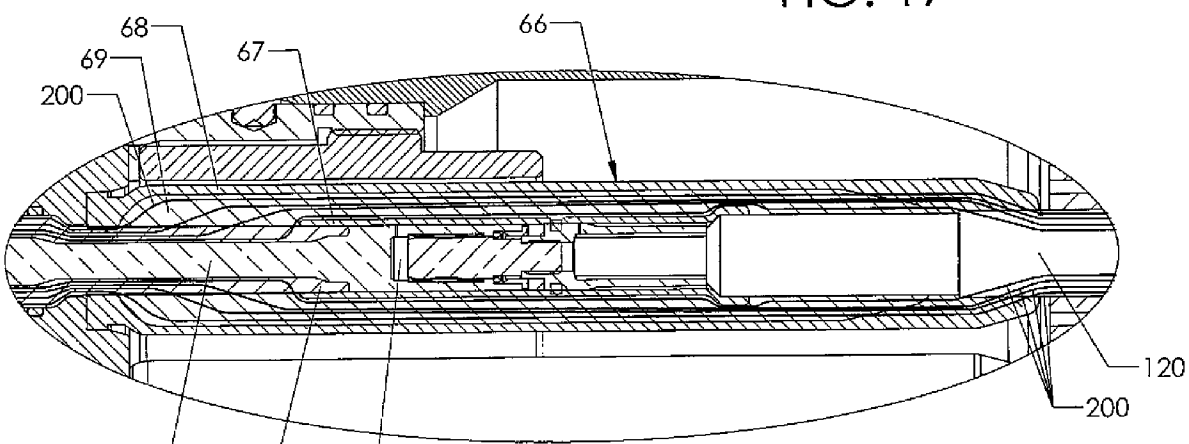
FIG. 18 is an enlarged view of the circled area labeled FIG. 18 in FIG. 12, illustrating the dielectric field equipotential lines at the boot seal shielded interface between the receptacle and cable.
Figure 16:
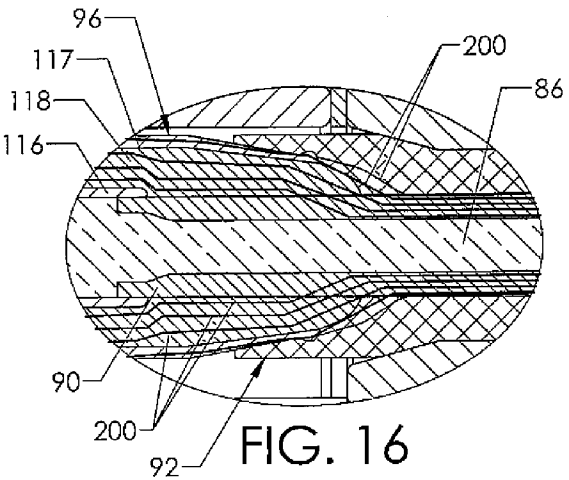
FIG. 16 is an enlarged view of the circled area labeled FIG. 16 in FIG. 12, illustrating the dielectric field equipotential lines at the plug rear seal interface.

The connector described above is designed for an electrical application. Due to its modular design, the connector may be used as a single phase or multi-phase connector, such as a three phase connector having three separate circuits connected by mating pin and socket elements in the plug and receptacle units, respectively. In a multi-phase connector, each circuit in each connector part is isolated from the other circuits by a ground plane and the mating plug and receptacle units are designed so that a continuation of the ground plane is provided between the units when fully mated. The pin or pins on the plug unit are each surrounded by semi-conductive seals and a conductive housing to provide a ground plane or shield from the rear end to the front of the unit. The conductive pins with forward end sockets in the receptacle unit are surrounded by a semi-conductive layer on the outer bladder from the rear end to the forward end seal integrally formed with the bladder, providing a ground plane surrounding the receptacle pins or conductors up to the forward end of the receptacle unit. The ground plane continues at the rear end of each unit up to the cables, with boot seals having semi-conductive layers, and with a rear end seal as in FIG. 10 and FIG. 11A for any rear end connection to an unshielded cable. FIGS. 16 to 18 illustrate the dielectric field equipotential lines 200 at the various interfaces in the mated connector unit of FIG. 12 which has a ground plane which extends from the rear end of plug unit 14 to the rear end of receptacle unit 12.

FIG. 16 is an enlarged view of the circled area labeled FIG. 16 in FIG. 12, and illustrates the dielectric field equipotential lines 200 at the interface between the plug rear seal 92 and the boot seal 96. As described above, this termination arrangement is used when the connection is made to an unshielded cable. Rear end seal 92 has an insulative inner layer 94 and a semi-conductive outer layer 95. The inner surface of the seal has a smooth, outwardly flared shape from the outer layer 90 of the pin. Without the rear end seal, the equipotential lines 200 would have a stress riser, e.g. a sharp distortion or spike, at the transition, resulting in insulation failure over time. The addition of the end seal with a smooth, outwardly flared shape smoothes and spreads the field, avoiding a spike or stress riser, as illustrated in FIG. 16. Since the cable 165 is not shielded, smoothing and spreading out of the electrical field lines for electrical stress relief is helpful in prolonging the lifetime of the connector. A similar arrangement may be used for connection of the rear end of either connector unit to an unshielded cable.

FIG. 17 illustrates the dielectric field equipotential lines at the interface between the plug front seal 105 and the forward end seal 58 of the receptacle unit. The ground plane surrounding the plug pin through the plug unit continues on through the semi-conductive seals 105 and 58 at the mated interface between the units, which are shaped to control and shape the equipotential lines 200 without creating a stress riser. The semi-conductive outer layer of the outer bladder in the receptacle unit forms a ground plane which surrounds the receptacle pin to control the equipotential lines through the receptacle unit so that they do not spread out. FIG. 18 illustrates the shape of the equipotential lines 200 at the interface between the receptacle boot seal 66 and the shielded cable 120. The ground plane continuation through the boot seal is provided by the semi-conductive outer layer 68 and the equipotential lines 200 are directed through the insulating layer 69 to the cable shield. The shape of the boot seal controls and shapes the equipotential lines without creating any stress riser, and directs and carries the ground plane to continue into the cable shield.

Figure 19:
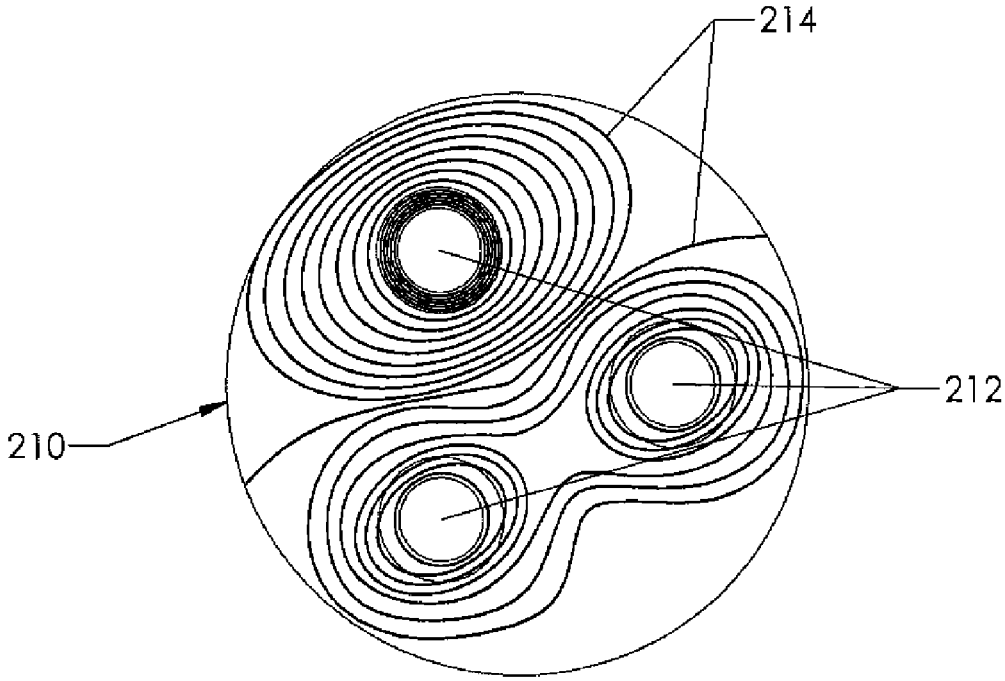
FIG. 19 is a cross-sectional view illustrating interaction between the dielectric field equipotential lines of an unshielded three phase connector.
Figure 20:
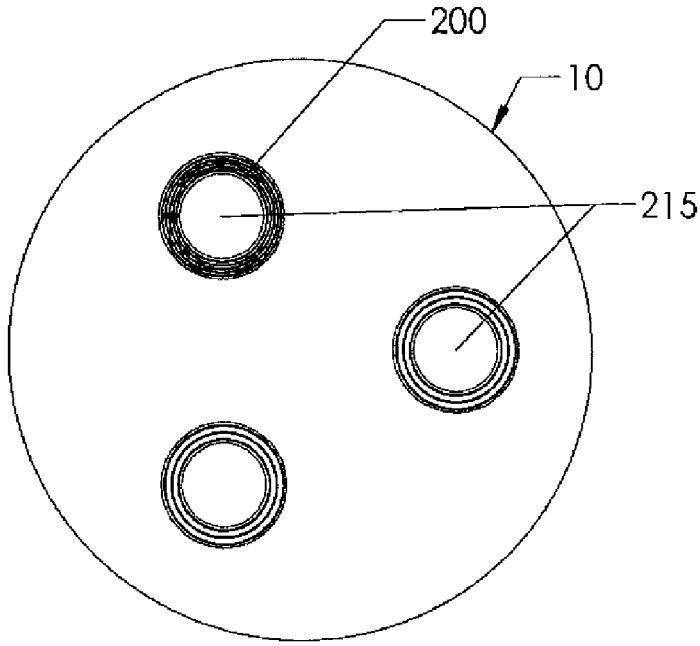
FIG. 20 is a cross-sectional view illustrating the isolated dielectric field equipotential lines in the shielded multi-phase connector of FIGS. 1 to 13 with three phases or circuits.

The ground shield arrangement in the connector described above helps to control the equipotential lines through the entire mated connector, helping to reduce or eliminate stress risers and distortions of the fields surrounding each mated contact pair in a multi-phase connector. FIGS. 19 and 20 illustrate the effect of the ground shielding by comparing an unshielded three phase connector 210 with the shielded connector unit 10 of FIGS. 1 to 13 and 16 to 18. FIG. 19 is a cross-sectional view through an unshielded three phase connector 210 having three contact modules or circuits 212. The equipotential lines 214 in this connector spread out around each contact module, resulting in phase to phase interactions and distortions of the field. This in turn results in electrical stress in the connector components, affecting performance in the long term.

FIG. 20 is a simplified cross sectional view through one unit of a mated three phase connector 10 with each phase or circuit 215 surrounded by equipotential lines 200. In the phase isolated, shielded multi-phase connector 10, unlike the unshielded connector of FIG. 19, equipotential lines of each circuit are contained within the ground shield so that they do not interact with any other phases. Any circuit failure results in connection to the ground plane.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A connector, comprising:

a first connector unit having at least one electrical pin, the pin having a forward end portion which projects in a forward direction and includes a first electrical contact;

a second connector unit having at least one contact chamber containing at least one electrical socket module which receives the electrical pin when the connector units are in a mated condition, the socket module including a second electrical contact;

the connector units being movable between an unmated condition and a mated condition in which they are in releasable mating engagement and the first and second contacts are in electrical communication;

the contact chamber having a forward end opening which receives the electrical pin, and a forward end seal assembly having at least one forward end seal which seals against the outer surface of the pin in the mated condition;

the first connector unit having a front pin seal which is engaged over part of the forward end portion of the pin at a location spaced from the electrical contact;

the front pin seal of the first connector unit being in sealing engagement with the forward end seal of the second connector unit in the mated condition of the units; and the front pin seal and forward end seal each comprising at least one layer of semi-conductive material.

2. The connector of claim 1, wherein said front pin seal comprises a single layer of a semi-conductive elastomeric material.

3. The connector of claim 1, wherein at least one of the seals comprises at least one layer of semi-conductive material and at least one layer of insulative elastomeric material.

4. The connector of claim 1, wherein each connector unit has a rear end cable connection configured for connection to an electrical cable, the electrical pin of the first connector unit having a conductive shaft extending to the rear end cable connection of the first connector unit, and the second connector unit having a conductive pin extending from the second electrical contact to the rear end cable connection of the second connector unit, the first connector unit has a continuous ground plane which surrounds the electrical pin and which extends from the front pin seal to the rear end cable connection, and the second connector unit has a continuous ground plane extending from the forward end seal which surrounds the conductive pin and extends from the forward end seal to the rear end cable connection.

5. The connector of claim 4, wherein the first connector unit has a plurality of electrical pin modules each comprising an electrical pin and a front pin seal engaging over part of the forward end portion of a respective electrical pin, and the second connector unit has a plurality of electrical socket modules configured for alignment with respective electrical pin modules when the units are mated, each electrical contact module comprising a contact chamber containing a respective second electrical contact and an electrical pin extending from the respective second electrical contact to the rear end cable connection, each contact chamber having a respective forward end opening positioned for receiving a forward end of a respective pin in the mated condition of the units and a forward end seal which seals against the outer surface of the respective pin and is in sealing engagement with the respective front pin seal in the mated condition of the connector units, each first contact being in electrical communication with a respective aligned second contact to form an electrical circuit through the connector in the mated condition, each electrical pin module having a ground plane which surrounds the electrical pin and extends from the respective front pin seal to the rear end cable connector, and each electrical socket module having a ground plane which surrounds the respective electrical pin and extends from the respective forward end seal to the rear end cable connection, whereby each circuit formed between the respective electrical pin and socket modules in the mated condition of the units is isolated from all the other circuits in the connector by the surrounding ground plane.

6. The connector of claim 1, further comprising at least one bladder of flexible material surrounding the contact chamber, the bladder having a forward end portion which comprises said forward end seal which seals against the pin in the mated condition of the units.

7. The connector of claim 6, wherein the bladder has at least one continuous layer of semi-conductive material extending from the forward end seal up to a rear end of the bladder.

8. The connector of claim 6, wherein each chamber is filled with a dielectric mobile substance.

9. The connector of claim 1, wherein the first connector unit has a plurality of electrical pins and a plurality of front pin seals each engaging over part of the forward end portion of a respective electrical pin, and the second connector unit has a plurality of contact chambers each containing a single electrical socket module, each contact chamber having a respective forward end opening positioned for receiving a forward end of a respective pin in the mated condition of the units and a forward end seal which seals against the outer surface of the respective pin and is in sealing engagement with the respective front pin seal in the mated condition of the connector units.

10. The connector of claim 9, wherein each contact chamber has an inner bladder surrounding the respective electrical socket module to form an inner contact chamber and an outer bladder surrounding the inner bladder to form an outer chamber between the inner and outer bladders, the inner and outer bladders each having a forward end portion which forms an end seal configured to seal against the outer surface of the respective pin in the mated condition of the units.

11. The connector of claim 10, further comprising passageways into the outer chamber formed between the forward end portions of each pair of inner and outer bladders.

12. The connector of claim 10, wherein each outer bladder has an inner layer of electrically insulative elastomeric material and an outer layer of semi-conductive material which seals against the respective pin seal in the mated condition of the units.

13. The connector of claim 10, wherein each outer and inner chamber of each of the contact chambers contains a dielectric mobile substance.

14. The connector of claim 1, wherein each connector unit has a rear end cable connection configured for connection to an electrical cable, the electrical pin of the first connector unit having a conductive shaft extending to the rear end cable connection of the first connector unit, and the second connector unit having a conductive pin extending from the second electrical contact to the rear end cable connection of the second connector unit, a first boot seal surrounding the rear end cable connection of the first connector unit and a second boot seal surrounding the rear end cable connection of the second connector unit.

15. The connector of claim 14, wherein each boot seal has at least an outer layer of semi-conductive material, whereby the connector is shielded from the rear end cable connection of the first connector unit to the rear end cable connection of the second connector unit when the units are in a mated condition.

16. The connector of claim 14, wherein at least one rear end cable connection is configured for connection to an unshielded cable, and a rear seal surrounds the interface between the conductive pin and boot seal of said one rear end cable connection.

17. The connector of claim 16, wherein the rear seal has an outer layer of silicone or fluorosilicone semi-conductive material and an inner layer of elastomeric insulating material.

18. The connector of claim 1, wherein the electrical pin has a rear end portion adapted for connection to a cable conductor, and a multi-layer boot seal surrounds the rear end portion of the pin.

19. The connector of claim 18, wherein the boot seal and front pin seal each have at least one layer of semi-conductive material and the first connector unit comprises a housing of conductive material through which the pin extends, whereby a continuous ground plane is formed at least from the rear end of the pin to the front pin seal.

20. The connector of claim 18, wherein the boot seal has at least one layer of insulating material and at least one layer of semi-conductive material.

21. The connector of claim 20, wherein the insulating material of the boot seal is silicone and the semi-conductive material of the boot seal is silicone or fluorosilicone.

22. The connector of claim 1, wherein the pin comprises a conductive probe shaft having a forward end comprising the first electrical contact, a rear end adapted for connection to a cable end connector, and an outer insulating layer extending along a major part of the length of the shaft and terminating short of the first electrical contact.

23. The connector of claim 22, wherein the pin is of stepped diameter and has rear and forward end portions and a central portion of greater diameter than the end portions, and the first connector unit has a front plate and a base plate having through bores through which the pin extends, the bore in the front plate being of stepped diameter matching the stepped diameter of the central and forward end portions of the pin, and parts of the central and forward end portions extending through the bore in the front plate.

24. The connector of claim 23, wherein the pin has a tapered shoulder between the central and forward end portion and the through bore in the front plate has a matching tapered transition between the different diameter portions of the through bore.

25. The connector of claim 22, further comprising a semi-conductive layer of rigid semi-conductive material sandwiched between the conductive shaft and outer insulating layer.

26. The connector of claim 25, wherein the semi-conductive layer is of engineering plastic or metal.

27. The connector of claim 25, wherein the semi-conductive layer is applied to the conductive shaft and the insulating layer is injection molded over the shaft.

28. The connector of claim 25, wherein the insulating layer is a separately formed tube having an inner surface and the semi-conductive layer is applied to the inner surface of the tube.

29. The connector of claim 25, wherein the semi-conductive layer comprises a painted coating of semi-conductive material.

30. The connector of claim 25, wherein the semi-conductive layer is a powder coating layer.

31. The connector of claim 25, wherein the semi-conductive layer is an injection molded layer.

32. The connector of claim 25, wherein the semi-conductive layer comprises a coating of semi-conductive material.

33. The connector of claim 1, wherein the socket module has a slidably mounted stopper which is biased into an extended position in an unmated condition of the second connector unit, the forward end seal assembly sealing against an opposing portion of the stopper in the unmated condition and sealing against an opposing portion of the pin in the mated condition of the units.

34. The connector of claim 33, comprising an inner bladder and an outer bladder of flexible material surrounding the contact chamber, the outer bladder being spaced from the inner bladder to form an independent outer chamber surrounding the contact chamber.

35. The connector of claim 34, wherein the outer bladder has an outer layer comprising said layer of semi-conductive material.

36. The connector of claim 34, further comprising a bladder support of rigid insulating or dielectric material located between at least the forward end portions of the bladders.

37. The connector of claim 34, wherein the bladders each have a forward end portion which forms an end seal which seals against an opposing end portion of the stopper in the unmated condition of the units and seals against an opposing portion of the pin in the mated condition of the units to form a dual end seal, the end seal of the outer bladder comprising the forward end seal which is in sealing engagement with the pin seal in the mated condition.

38. The connector of claim 37, wherein the inner bladder defines the inner, contact chamber and the space between the inner and outer bladder defines an outer chamber, and passageways into the outer chamber are formed between the end seals of the inner and outer bladder.

39. The connector of claim 34, wherein the outer bladder comprises at least an inner layer of electrically insulative elastomeric material and an outer layer of semi-conductive material.

40. The connector of claim 39, wherein the inner and outer layers are bonded together.

41. The connector of claim 39, wherein the inner and outer layers are integrally formed.

42. The connector of claim 39, wherein the inner layer has an outer surface and the outer layer comprises a coating of semi-conductive material painted onto the outer surface of the inner layer.

43. A connector, comprising:

a first connector unit having at least first and second electrical pins, each pin having a forward end portion which projects in a forward direction and includes an electrical contact, a first front pin seal engaged over part of the forward end portion of the first electrical pin and a second front pin seal engaged over part of the forward end portion of the second electrical pin, each front pin seal being spaced from the respective electrical contact;

a second connector unit having at least first and second contact chambers each containing a respective electrical socket module, the first and second electrical socket modules being positioned to receive a forward end portion of the first and second electrical pin, respectively, when the connector units are in a mated condition, each socket module including an electrical contact;

the connector units being movable between an unmated condition and a mated condition in which they are in releasable mating engagement and the electrical contacts of the first pin and first socket module and the electrical contacts of the second pin and second socket module are in electrical communication;

each contact chamber having a forward end opening which receives the electrical pin, and a forward end seal assembly which seals against the outer surface of the pin in the mated condition; and a first dual bladder assembly surrounding the first contact chamber and a separate, second dual bladder assembly surrounding the second contact chamber, each bladder assembly comprising an inner bladder of flexible material defining an inner contact chamber in which the electrical socket module is located and an outer bladder of flexible material surrounding the respective inner bladder to define an outer chamber between the inner and outer bladders, each outer bladder having a forward end portion which forms a forward end seal and each inner bladder having a forward end portion which forms an additional end seal independent from the forward end seal, the forward and additional end seals of the first and second dual bladder assemblies comprising the forward end seal assemblies of the respective first and second contact chambers, and each forward end seal being in sealing engagement with the front pin seal of the respective aligned electrical pin in the mated condition of the units.

44. The connector of claim 43, wherein each bladder assembly has a forward end portion and a rear end portion, the chambers extending between the forward and rear end portions, and a bladder support of rigid material extending between the forward and rear end portions, each bladder support comprising a front tubular end portion, a rear tubular end portion, and a plurality of spaced stand off rods extending through the respective outer chamber between the front and rear tubular end portions.

45. The connector of claim 43, wherein each socket module has a slidably mounted stopper which is biased into an extended position in an unmated condition of the second connector unit, each forward end seal assembly sealing against an opposing portion of the respective stopper in the unmated condition and sealing against an opposing portion of the respective pin in the mated condition of the units.

46. The connector of claim 43, wherein the first bladder assembly has a plurality of first passageways extending between the forward and additional end seal into the first outer chamber and the second bladder assembly has a plurality of second passageways extending between the forward and additional end seals into the second outer chamber.

47. The connector of claim 46, wherein each bladder assembly further comprises a rigid bladder support tube between the forward end portions of the inner and outer bladders.

48. The connector of claim 47, wherein each inner bladder has an outer surface which has spaced first channels extending from the additional end seal towards the outer chamber, and each support tube has an inner surface having spaced second channels extending from the first channels on the respective inner bladder to the outer chamber, the first and second channels of the first and second bladder assembly comprising said first and second passageways, respectively.

49. The connector of claim 43, wherein the first and second front pin seals and first and second outer bladders each have at least one layer of a semi-conductive material.

50. The connector of claim 49, wherein the first and second pin seals each comprise a single layer of semi-conductive material.

51. The connector of claim 49, wherein the first and second pin seals each comprise an outer layer of semi-conductive material and an inner layer of electrically insulating, elastomeric material.

52. The connector of claim 49, wherein each inner and outer chamber contains a dielectric mobile substance.

53. The connector of claim 49, wherein the first and second outer bladders each have an inner layer of insulative elastomeric material and an outer layer of semi-conductive material.

54. The connector of claim 53, wherein the insulative elastomeric material is silicone and the semi-conductive material of each bladder outer layer and each pin seal is silicone or fluorosilicone.

55. A connector, comprising:

a first connector unit having at least one electrical pin, the pin having a forward end portion which projects in a forward direction and includes a first electrical contact;

a second connector unit having at least one contact chamber containing at least one electrical socket module which receives the electrical pin when the connector units are in a mated condition, the socket module including a second electrical contact;

the connector units being movable between an unmated condition and a mated condition in which they are in releasable mating engagement and the first and second contacts are in electrical communication; and the electrical pin having front and rear ends, a conductive shaft extending from the front to the rear end, the shaft having an outer surface, an outer layer of non-conductive, insulating material extending along at least part of the length of the pin and terminating at a location spaced rearwardly from the front end of the pin, the outer layer having an inner surface, and an intermediate layer of rigid conductive or semi-conductive material sandwiched between the outer layer and conductive shaft.

56. The connector of claim 55, wherein the intermediate layer comprises a substantially void-free coating of conductive or semi-conductive material on the outer surface of the conductive shaft or the inner surface of the outer layer.

* * * * *